United States Patent [19]

Cholkeri

[11] Patent Number: 4,667,069

[45] Date of Patent: May 19, 1987

[54] MULTIPLE DISC PRESSURE RESPONSIVE CONTROL DEVICE

[75] Inventor: Pandu R. Cholkeri, Worthington, Ohio

[73] Assignee: Ranco Incorporated, Dublin, Ohio

[21] Appl. No.: 766,829

[22] Filed: Aug. 16, 1985

[51] Int. Cl.[4] ..... H01H 35/34

[52] U.S. Cl. ..... 200/83 P; 200/83 B; 92/103 M; 267/159; 428/687

[58] Field of Search ..... 92/97, 193 M; 337/319, 337/320; 267/15 A, 159; 200/83 P, 83 B, 83 J, 83 R, 83 Y, 302; 428/687

[56] References Cited

U.S. PATENT DOCUMENTS

| | | | |
|---|---|---|---|
| 2,860,208 | 11/1958 | Epstein | 267/159 |
| 3,585,328 | 6/1971 | Fiore et al. | 200/83 B |
| 3,816,685 | 6/1974 | Fiore | 200/83 P |
| 4,200,776 | 4/1980 | Poling | 267/159 |
| 4,296,287 | 10/1981 | Boulanger | 200/83 P |

*Primary Examiner*—G. P. Tolin

*Attorney, Agent, or Firm*—Watts, Hoffmann, Fisher & Heinke

[57] ABSTRACT

A pressure responsive control device having a pressure housing assembly defining a pressure chamber, an actuable controller fixed to the housing assembly and, a pressure transducer hermetically closing the pressure chamber. The transducer includes plural duplicate snap acting pressure responsive diaphragms, a diaphragm control plate hermetically bonded to the diaphragms and a support member hermetically joined between the control plate and the housing assembly. The diaphragms each are formed from thin sheets of spring metal and includes a central dome section having a surface finish less than 6 microinches A.A. on both sides. The diaphragms are nested together so that confronting faces of the dished sections are engaged when the diaphragms flex.

5 Claims, 3 Drawing Figures

MULTIPLE DISC PRESSURE RESPONSIVE CONTROL DEVICE

DESCRIPTION

1. Technical Field

The present invention relates to pressure responsive control devices and more particularly to pressure responsive control devices employing multiple snap acting diaphragms calibrated to respond to predetermined sensed pressures.

Fluid pressure responsive control devices employing snap acting diaphragms for actuating a switch, or the like, are widely used for various pressure controlling functions. For example, these kinds of controls are used in refrigeration systems for governing the operation of a refrigerant compressor in response to sensed system refrigerant pressures. Devices of this sort must be small, inexpensive, accurate and highly reliable in order to find a market.

These kinds of pressure controls are often used to cycle a controlled device and thus respond to the existence of a predetermined high pressure level as well as to the existence of a predetermined lower pressure level. When controlling an air conditioner in accordance with sensed refrigerant condenser pressures, for example, the control device senses the existence of a predetermined high refrigerant pressure in the condenser and reacts to terminate operation of the refrigerant compressor. When the sensed condenser refrigerant pressure reaches a given lower level the control device reacts again to enable operation of the compressor.

A typical pressure responsive snap acting diaphragm is a thin, internally stressed sheet metal spring disc having a central, dome section. When a sufficiently large pressure differential is applied to the diaphragm in a direction tending to flatten the dome section the dome section abruptly moves, or snaps, through the diaphragm center plane to a second position where the dome section is oppositely dished. When the pressure differential is reduced to a sufficiently low level the dome section snap moves back through the center plane to its initial position. The diaphragm motion is typically transmitted mechanically to a switch or a valve.

The high pressure level causing the diaphragm motion can be altered by changing the configuration of the dome diaphragm section. If the dome section is made deeper, the pressure differential required to move the diaphragm is increased. If the dome section is flattened a relatively smaller pressure differential causes the diaphragm to respond.

The low pressure level at which the diaphragm returns to its initial position is controlled by limiting the extent of movement of the dome section beyond the center plane. If the dome section moves well beyond the center plane a relatively low pressure is required to exist before the diaphragm snaps back to its initial position. If the dome section moves just across the center plane, it snaps back when a relatively larger pressure differential exists.

These diaphragms must be quite thin in order to perform in the manner described and therefore the magnitude of the pressure controllable by a single diaphragm, relative to atmospheric pressure, is limited. In order to permit the control of greater absolute pressure levels by snap diaphragm control devices it has been common practice to construct such devices using a plurality of duplicate pressure diaphragms which are nested together. Each diaphragm functions essentially the same way it would if no other diaphragms were present, but the resistance to movement by pressure differentials applied to the stack varies as a function of the number of diaphragms.

While stacking diaphragms has enabled production of control devices which respond to relatively large differential pressures, these devices have not been satisfactory for use in situations where accurate responses to applied pressure differentials were required throughout a large number of cycles. Typically, a stacked diaphragm pressure control device responds accurately to predetermined high and low pressures of a pressure range to be controlled for a relatively small number of cycles of the diaphragm stack. Then the control device begins to "drift" from its calibrated settings. In many cases, the high pressure levels responded to increase markedly from the calibrated settings as the number of cycles increases, while the low pressure levels responded to are of progressively reduced magnitude.

In order to be qualified by U.L. requirements as a refrigeration pressure limiting control, devices of the sort referred to must be able to operate over a minimum of 100,000 cycles with no more than a 5% upward deviation from the calibration pressure levels. Generally speaking, nested diaphragm pressure control devices either fail prior to completing 100,000 cycles, or exhibit pressure response deviations greater than 5% from the calibration settings, or both.

This disadvantage of stacked diaphragm pressure control devices has limited the use of such devices to environments where a control device is not required to operate through a large number of cycles or where highly accurate control of fluid pressure is not essential. Pressure responsive diaphragm controls are desirable because they are usually of simple construction, small and relatively inexpensive. Accordingly, many attempts have been made to produce a reliable, accurate multiple diaphragm pressure control device.

2. Background Art

It is widely believed that multiple diaphragm pressure control devices fail to accurately maintain pressure settings through large numbers of operational cycles because of the interactions between of the diaphragm surfaces during operation. In particular, it has been believed that the nested diaphragms, urged towards engagement by the applied pressure forces, contacted one another along extremely small area locations of the central dome sections so that the unit contact pressures between adjacent diaphragms were high. This, in turn, created large frictional forces between the diaphragms so that when the stacked diaphragms were flexed by the applied differential pressure and the diaphragm surfaces moved relative to each other, the surfaces experienced galling and abrasion.

As the number of cycles increased, the affected areas were thought to increase in size, thus causing more resistance to movement of the diaphragm stack by applied differential pressures. The diaphragms were generally fashioned from precision foil materials, such as stainless steel spring material, having a thickness of about 0.005 inches and a surface finish ranging between 9 and 20 microinches. (The surface texture of a metal is a function of the differences in height between microscopic peaks and valleys on the metal surface. The "smoothness" referred to is the arithmetic average of these differences in height and is expressed as "microinches A.A.")

In order to reduce the effects of galling, it was proposed that the diaphragms be covered with adherent oxide coatings. An example of such an approach is disclosed by U.S. Pat. No. 3,585,328. The theory was that the oxide coatings reduced metal to metal contact between the diaphragms which thus avoided or ameliorated the problem of galling. Indeed, the application of some oxide coatings to pressure control diaphragms reduced the tendancy of the devices to exhibit unacceptably high pressure setting "drift" over a large number of cycles, but still did not eliminate gradual increases in operating pressures as the number of cycles increased. For example, such control devices, when subjected to 100,000 cycles of operation generally do not drift more than 5% from the calibration pressures; but the continued drifting after 100,000 cycles often produces large absolute deviations from the calibration settings, particularly when the devices are operated from 500,000 to 1,000,000 cycles. The direction of these deviation from calibrated high pressure levels was also unfortuante because the high level pressure needed to actuate the devices typically continued to increase throughout the life of the control device, thus subjecting the controlled equipment to ever greater fluid pressures.

In an effort to further improve performance of multiple diaphragm pressure control devices without requiring the application of oxide coatings, various multiple diaphragm control device constructions have been tried out. Among these approaches have been the use of low friction diaphragm coatings, such as TEFLON, specially polished diaphragms, and diaphrams which had various types of plated surfaces. These approaches to the problem of pressure setting drifting were all consistent with the theory that reduction of metal to metal contact between the diaphragms themselves would reduce galling and thus eliminate excessive control pressure setting drift. In practice, while some of these device constructions did exhibit reduced drift from the calibration setting levels, they suffered early failures because of diaphragm cracking.

The experimentation had attempted to further limit the effects of friction and possible metal-to-metal diaphragm contact by ulitizinng diaphragm metals which had smoother surfaces than typical prior art constructions. Diaphragm metal having surface finishes in the range of 6–8 microinches A.A. were employed. These diaphragms were plated, coated or polished before assembly in a control device and tested. These devices did not exhibit improved operation over previously known devices employing oxide coated diaphragms, for example. In fact, the test diaphragms most typically tended to fail due to cracking at relatively low numbers of cycles whether or not the diaphragms were coated.

DISCLOSURE OF INVENTION

The present invention provides a new and improved multiple diaphragm pressure control device employing nested metal diaphragms having extremely smooth surfaces engageable when the diaphragms are flexed by applied differential pressures and which continues to be operated at or below its calibrated high pressure level throughout extremely large numbers of operational cycles.

According to a preferred embodiment of the invention, a pressure responsive control device is provided which includes a pressure housing assembly defining a pressure chamber, an actuatable control element fixed to the housing assembly, and, a pressure transducer hermetically closing the pressure chamber. The pressure transducer comprises a plurality of snap acting pressure responsive diaphragms each defining a central dome section and a surrounding peripheral section. The diaphragms are stacked together with their central sections nested. Each central section is defined by a thin sheet of metallic spring material having a surface finish less than 6 microinches A.A. on each side with confronting surfaces of the central sections engaged.

It has been discovered that pressure responsive devices employing nested snap acting diaphragams exhibit greater accuracy over large numbers of pressure cycles of the prior art devices when the diaphragms are constructed from thin sheets of metal spring material having surface finishes of less than 6 microinches A.A. This performance represents a substantial improvement over that of previously known multiple diaphragm devices which have typically employed thin spring metals having surface finishes of greater than 6 microinches A.A.

Moreover, the consequence of using uncoated extremely smooth nested diaphragms in a pressure responsive device of the character referred to is that the surfaces experience, or should experience, increased metal-to-metal contact compared to the prior art. Such contact would theoretically create increased diaphragm galling and even earlier failures. The increased life and improved accuracy of the new control device has therefore been unexpected.

BEST MODE FOR CARRYING OUT THE INVENTION

Figure 1:
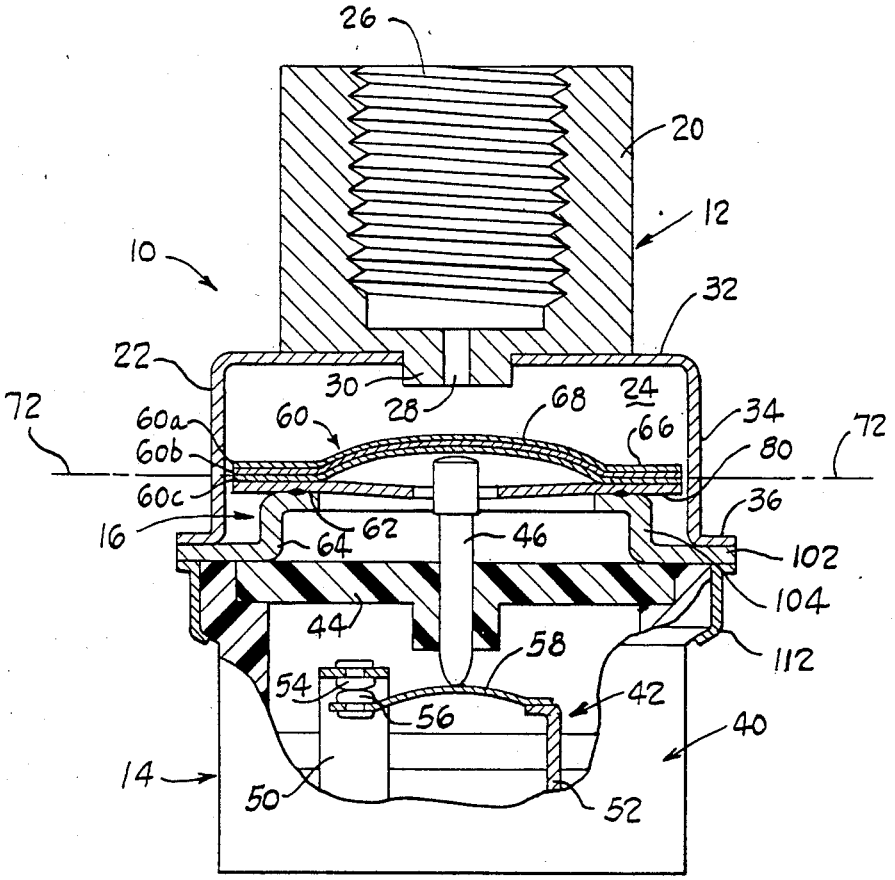
FIG. 1 is an elevational view of a control device embodying the present invention with portions broken away and parts illustrated in cross-section.
Figure 2:
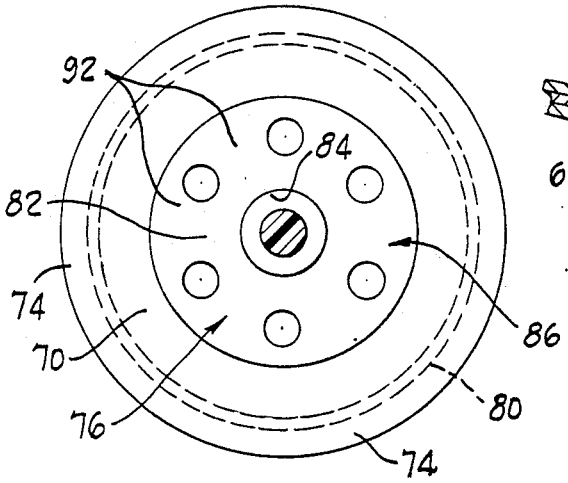
FIG. 2 is a view seen approximately from the plane indicated by the line 2—2 of FIG. 1.
Figure 3:
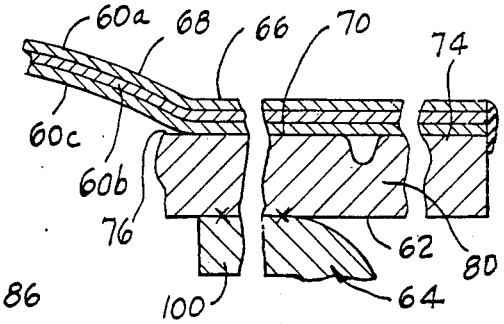
FIG. 3 is fragmentary cross sectional view of part of the device of FIG. 1 within the line 3—3 of FIG. 1.

A pressure control device 10 embodying the present invention is illustrated by FIG. 1 of the drawing. The illustrated pressure control device 10 is of the sort which is employed in a refrigertion system, for example, for cycling operation of an electric motor driven refrigerant compressor in response to sensed system refrigerant pressure levels in the condenser. The device 10 communicates with refrigerant in the condenser and when the refrigerant pressure reaches a predetermined relatively high level the control device 10 detects the pressure level and discontinues operation of the compressor. When the sensed refrigerant pressure level reaches a predetermined lower level the control device 10 responds to enable re-initiation of compressor operation.

The control device 10 comprises a pressure housing assembly 12 constructed to communicate with system refrigerant, a control switch assembly 14 electrically connected in a compressor motor controlling circuit, and a pressure transducer assembly 16 between the housing assembly 12 and the switch assembly 14.

The housing assembly 12 comprises a suitable pressure fitting 20 hermetically attached to a cup-like casing 22 which defines an internal pressure chamber 24. The fitting 12 can be of any suitable or conventional construction and is illustrated as formed by a body having an internal threaded passage 26 terminating in a pressure transmitting port 28 extending through a projection 30 at the end of the body. A refrigerant pressure transmitting metal tube (not illustrated) is threaded into the fitting 20 and sealed in place in order to transmit refrigerant pressure from the refrigeration system to the control device.

The casing 22 is preferably formed by a drawn stainless steel cup having a base 32, a cylindrical wall 34 extending from the base and an outwardly flared mounting flange 36 at the end of the cup wall remote from the base. The base 32 defines an aperture through which the fitting projection 30 extends. The end of the projection 30 is brazed to the cup base 32. The fitting is brazed to the casing 22 about the projection 30 so that the juncture of the pressure fitting and the casing is hermetic.

The control switch assembly 14 comprises a molded plastic cup-like switch case 40 supporting a switch unit 42 within it. A plastic cover member 44 extends across the open end of the switch case and defines a central opening through which a switch operating pin 46, formed from a dielectric material, extends. The operating pin 46 transmits switch operating motion between the pressure transducer 16 and the switch unit 42.

The switch unit 42 is formed by terminal bars 50, 52 fixed in the switch case. The terminal bar 50 carries a fixed switch contact 54 while the terminal bar 52 supports a movable switch contact 56 mounted at the projecting end of an electrically conductive cantilevered resilient blade 58.

In the preferred control device the terminals 50, 52 extend through conforming openings in the closed end of the switch case 40 and are staked in place with respect to the case. The terminal bars 50, 52 project from the closed end of the case 40 (not illustrated) and are wired into a circuit for controlling energization of the refrigerant compressor. When the switch contacts are engaged, as illustrated by FIG. 1, the switch unit 42 is conductive to enable operation of the refrigerant compressor. The switch contacts are opened by deflection of the blade 58 in a direction away from the pressure transducer 16 so that the compressor controlling circuit is interrupted.

The pressure transducer 16 hermetically closes the chamber 24 and functions to operate the control switch assembly 14 in response to the detected refrigerant pressure in the chamber. In the illustrated and preferred embodiment the pressure transducer comprises a diaphragm assembly 60, a diaphragm control plate 62 hermetically connected to the diaphragm assembly and a base member 64 for supporting the control plate and hermetically joining the control plate to the casing 22. Air at or close to atmospheric pressure is present in the switch case 40 so that the transducer is subjected to differential pressure forces which vary according to changes in the system refrigerant pressure.

The diaphragm assembly 60 comprises a plurality of diaphragms each formed by a thin spring metal sheet providing an initially flat annular section 66 disposed about a central dished, or dome, section 68. The illustrated embodiment of the invention includes three diaphragms **60*a*, 60*b*, 60*c* stacked with their dome sections nested together. Each diaphragm is internally stressed such that when no pressure differential exists across the diaphragm assembly the dome sections 68 are biased to the positions illustrated by FIG. 1** of the drawings.

When a pressure differential is applied across the diaphragm assembly in a direction tending to flatten the dome sections (viz. when the pressure in the chamber 24 increases above ambient atmospheric pressure) the dome sections remain substantially stationary until a predetermined differential pressure level is reached at which time each dome section abruptly moves in snap fashion through the plane of the associated annular section 66 and assumes a second position in which the curvature of the dome section is reversed. The dome sections remain in their second positions until the pressure differential across the diaphragm assembly has been reduced to a predetermined lower level at which time the dome sections snap move back to their initial positions.

The chamber pressure levels at which the diaphragm assembly moves are determined by the internal stresses in each diaphragm and the combined effect of those stresses in the diaphragm assembly. The diaphragm stresses are in turn governed by the configuration of the diaphragm control plate 62. The control plate 62 comprises a supporting region 70 for engaging and supporting the diaphragm assembly along a reference plane, generally indicated by the reference character 72, a first diaphragm control region 74 surrounding the supporting region 70, and a second diaphragm control region 76 surrounded by the supporting region 70. After the diaphragm assembly is attached to the control plate the control plate is subjected to controlled deformations to position the control regions for governing the differential pressure levels at which the diaphragm assembly moves between its positions.

The control region 74 is formed by an annular outer marginal portion of the control plate and is hermetically welded to the diaphragm 60 continuously about its outer periphery. The control region is connected to the supporting region 70 by a deformable weakened plate section 80 to enable controlled movement of the control region 74 relative to the supporting region 70 during calibration without any material deformation or change of position of the supporting region or the control region 76 occurring. In the preferred embodiment the weakened plate section 80 is formed by a circumferential groove, or notch, which surrounds the supporting region.

The control region 74 and the diaphragm assembly section supported on it project outwardly from the supporting region 70 wholly into the pressure chamber 24. This feature assures that the high pressure chamber fluid completely surrounds the control region 74 and the diaphragm margin so that unbalanced pressure forces can not be exerted on the control region 74. There is thus no tendency for the control region to be yieldably deflected from its calibrated position by high pressure fluid in the chamber 24 during use of the control device 10.

The second diaphragm control region 76 is formed by a dome engaging face 82 surrounding a central plate opening 84. The face 82 engages the dome section 68 about the opening 84 to limit the snap motion of the diaphragm assembly dome section from its first position and thus defines the second position of the dome section. The control region 76 is joined to the supporting region 70 by a weakened yieldably deformable plate section 86. The section 86 allows the second control region to be controllably displaced relative to the supporting region during calibration without significant deformation or change of position of the supporting region or the first control region 74.

The supporting region 70 rigidly supports a major portion of the annular diaphragm section 66 in full face contact along the plane 72. The pressure differential between the chamber 24 and the atmosphere ambient the control maintains the diaphragm engaged across the face of the supporting region 70 during normal operation of the control device so that the diaphragm position remains stabilized.

The base member 64 is preferably formed by a sheet metal cup-like body hermetically joined to the control plate 62 and constructed and arranged for hermetic attachment to the casing 22 when the control device 10 is assembled. The base member 64 comprises a first body portion 100 hermetically attached to and rigidly supporting the plate region 70, a second body portion 102 constructed for attachment to the casing 22 and an imperforate generally cylindrical wall 104 interconnecting the body portions 100, 102.

The body portion 100 is preferably formed by an annular flange projecting radially inwardly from the body wall 104 for engaging and supporting the region 70. In the preferred embodiment the flange corresponds in size and shape to the region 70 so that the region 70 is fully supported. The flange and supporting region are joined by a hermetic weld which extends continuously about the center of the region 70. The joint is preferably formed by a resistance weld, but could be formed by other suitable welding techniques.

The body portion 102 defines a mounting flange projecting radially outwardly from the wall 104 to provide a flat rigid locating face for the switch assembly and an outer peripheral margin confronting and engaging the casing flange 36. The flange 36 and margin of the body 102 are hermetically joined by a continous circumferential weld. The weld joint between the flange 36 and the body margin must provide a high degree of burst strength because it is subjected to refrigerant pressure in the chamber 24. Accordingly, a relatively large, high strength weld joint must be formed between these parts and a plasma weld is preferred.

In the illustrated embodiment a switch mounting ring 112 is welded to the body margin at the same time the flange 36 and body margin are welded together. The ring 112 is then clinched to the switch casing to complete the control device assembly.

The juncture between the switch assembly and the module 16 is not hermetically sealed and accordingly the interior of the control device 10, except for the chamber 24, is initially exposed to ambient atmospheric pressure. The preferred control devices are frequently potted, i.e, the switch casing and related parts are covered by a suitable compound which serves to seal the interior of the control from the surroundings. The atmospheric air in the device is trapped by the potting material and thus the interior of the control switch casing remains at or about atmospheric pressure under most conditions of use of the device.

The pressure transducer is calibrated to respond to predetermined high and low pressure levels in the same manner as is set forth in copending U.S. patent application Ser. No. 668,001 filed Nov. 5, 1984, now U.S. Pat. No. 4,573,398, issued Mar. 4, 1986. The disclosure of which is incorporated herein in its entirety by this reference to it. Reference should be made to that disclosure for further information concerning the device 10.

An important aspect of the present invention resides in constructional features of the diaphragm assembly 60. The diaphragms constituting the assembly 60 are plural duplicate stampings of sheet spring metal which, when assembled in the device 10, react to applied pressure differentials essentially the same as a single snap diaphragm. In the preferred and illustrated embodiment of the invention, the diaphragms are stamped from a 0.00525 inch thick sheet of 301 stainless steel. Up to nine of these stamped diaphragms have been nested together to form the diaphragm assembly, depending upon the level of pressure the device 10 is to be used to control.

The nested diaphragms are maintained in intimate full surface contact while being welded together about their peripheries so that the preferred assembly is essentially a unitary, very thin diaphragm structure. The diaphragms are preferably joined by plasma arc welding process which assures that the diaphragm edges are hermetically attached to each other.

The diaphragm assembly, support plate and the base 64 are then welded together to complete the pressure transducer assembly. After the stamping and welding steps are completed the transducer is stress relieved to eliminate or substantially reduce internal stresses created during the manufacturing operations.

The construction of the diaphragm assembly assures that the outer peripheral sections of the diaphrams are fixed together and do not experience relative motion when the diaphragm assembly dome section snaps between positions. The dome sections of the individual diaphragms, on the other hand, move relative to each other slightly during the snap movement. The diaphragm dome sections are urged together by the pressure forces acting on the assembly and accordingly movement of the diaphragm dome sections from either of their stable positions is resisted by friction forces acting between the engaged dome section faces. It has been thought that the large unit engagement pressures between the diaphragm surface areas in contact with each other create sufficient heat during relative movement of the diaphragm domes that galling of the diaphragm surfaces occurred. The galling process was presumed to be progressive over the life of the device because of observations that the pressure levels being controlled progressively increased with time.

It has been discovered, however, that where the surface finish of the diaphragm dome sections is less than 6 microinches, A.A., the pressure control settings do not progressively drift higher over time. In fact, the high pressure setting levels tend to gradually diminish over time, a phenomenon which might be the result of gradual diaphragm stress relief. Low pressure setting levels have been observed to generally drift slightly higher after a large number of cycles.

Testing of multiple diaphragm pressure devices has demonstrated that the diaphragm surface finish is a critical factor in establishing long life and a high degree of accuracy. In the preferred device 10, precision rolled stainless steel sheet or foil is used which has surface finishes of no more than about 2–3 microinches A.A. in the direction of rolling and no more than about 2–4 microinches A.A. transverse to the direction of rolling on both sides of the sheet. Such materials can be obtained, for example, from Teledyne Rodney Metals under standard finish number 1F or 2F.

Sheet metal materials having 2F standard surface finishes have been found quite suitable for use in the pressure control device 10. The 2F standard finish provides surface textures, or finishes, of 2–3 microinches A.A. longitudinally and 2–4 microinches A.A. transversely to the rolling direction. Diaphragms formed from sheets having standard finishes of 4F have longitudinal smoothness in the range of 4–6 microinches and transverse finishes in the range of 6–8 microinches A.A. Such diaphragms have not performed satisfactorily.

Life testing of the new diaphragm assembly construction has produced no failures due to diaphragm cracking even through some devices were tested through one million cycles. After 100,000 cycles the new constructions have exhibited worst case high pressure setting drifts of no more than minus 3.3 percent and low pressure setting drifts of minus 2.9 percent. Worst case setting shifts after 500,000 cycles were minus 5.9 percent (high pressure) and plus 5.3 percent (low pressure).

Control devices constructed according to the invention have been tested in excess of one million cycles with the worst case high pressure setting drift observed at minus 6.7 percent and worst case low pressure drift at plus 0.6 percent.

While a preferred embodiment of the invention has been illustrated and described in detail, the present invention is not to be considered limited to the precise construction disclosed. Various adaptations, modifications and uses of the invention may occur to those skilled in the art to which the invention relates and the intention is to cover all such adaptions, modifications and uses falling within the spirit or scope of the appended claims.

I claim:

1. A pressure responsive control device comprising:

(a) a pressure housing assembly defining a pressure chamber;

(b) control means supported by said housing assembly comprising a control member actuatable between first and second control positions; and, (c) a pressure transducer hermetically closing the pressure chamber and effective to actuate said control member, said pressure transducer comprising a plurality of snap acting pressure responsive diaphragms each defining a central dome section and a surrounding peripheral section, said diaphragms stacked together with their central sections nested, each central section defined by a thin sheet of metallic spring material having a surface finish less than 6 microinches A.A. on the confronting surfaces thereof.

2. The control device claimed in claim 1 wherein the surface finish of said central sections ranges between 1 and 4 microinches A.A.

3. The control device claimed in claim 1 wherein each diaphragm is formed from a thin sheet of spring metal and said diaphragms are hermetically joined together along said peripheral sections.

4. The control device of claim 3 wherein said diaphragms are duplicates.

5. The control device claimed in claim 3 wherein said diaphragms are formed from stainless steel and said control means comprises an electrical switch for closing and interrupting an electrical control circuit.

* * * * *